US007062051B2

(12) United States Patent
Harris et al.

(10) Patent No.: US 7,062,051 B2
(45) Date of Patent: Jun. 13, 2006

(54) ACOUSTIC DEVICE

(75) Inventors: Neil Harris, Cambridge (GB); Henry Azima, Cambridge (GB)

(73) Assignee: New Transducers Limited, Cambs (GB)

( * ) Notice: Subject to any disclaimer, the term of this patent is extended or adjusted under 35 U.S.C. 154(b) by 96 days.

(21) Appl. No.: 10/450,030

(22) PCT Filed: Aug. 15, 2002

(86) PCT No.: PCT/GB02/03778

§ 371 (c)(1),
(2), (4) Date: Mar. 15, 2004

(87) PCT Pub. No.: WO03/026344

PCT Pub. Date: Mar. 27, 2003

(65) Prior Publication Data

US 2004/0156515 A1 Aug. 12, 2004

Related U.S. Application Data

(63) Continuation-in-part of application No. 10/219,932, filed on Aug. 16, 2002, now abandoned.

(60) Provisional application No. 60/315,702, filed on Aug. 30, 2001.

(30) Foreign Application Priority Data

Aug. 17, 2001 (GB) ..... 0120130

(51) Int. Cl.
*H04R 25/00* (2006.01)

(52) U.S. Cl. ..... 381/152; 381/431; 381/423; 381/337; 381/354

(58) Field of Classification Search ..... 381/152, 381/431, 423, 337, 353, 354, 96, 426; 181/166
See application file for complete search history.

(56) References Cited

U.S. PATENT DOCUMENTS

| | | | |
|---|---|---|---|
| 5,615,275 | A | 3/1997 | Bertagni |
| 6,332,029 | B1 | 12/2001 | Azima et al. |
| 6,731,764 | B1 | 5/2004 | Asada et al. |
| 2003/0035560 | A1 | 2/2003 | Harris et al. |

FOREIGN PATENT DOCUMENTS

| | | |
|---|---|---|
| WO | WO 97/09842 | 3/1997 |
| WO | WO 99/02012 | 1/1999 |
| WO | WO 99/56497 A1 | 11/1999 |
| WO | WO 00/15000 A1 | 3/2000 |
| WO | WO 00/22877 A1 | 4/2000 |

OTHER PUBLICATIONS

International Search Report dated May 26, 2003.

*Primary Examiner*—Huyen Le
*Assistant Examiner*—Tuan Duc Nguyen
(74) *Attorney, Agent, or Firm*—Foley & Lardner LLP

(57) ABSTRACT

A method of improving the modal resonance frequency distribution of a panel (2) for a distribution resonant mode bending wave acoustic device involves analysing the distribution of the modal resonance frequencies of the panel, identifying a modal resonance frequency that is non-uniformly spaced relative to adjacent modal resonance frequencies, identifying a location on said panel that exhibits anti-nodal behaviour at said modal resonance frequency and changing the local impedance to bending wave vibration at said location (6). The method has particular application to distributed mode loudspeakers (1).

21 Claims, 8 Drawing Sheets

Table 1

| Mode No. | 1,1 | 2,0 | 0,2 | 2,1 | 1,2 | 3,0 | 3,1 |
|---|---|---|---|---|---|---|---|
| Hz | 59.312 | 70.800 | 131.67 | 140.53 | 171.78 | 207.51 | 269.09 |

| Mode No. | 2,2 | 0,3 | 4,0 | 1,3 | 3,2 | 4,1 | 2,3 |
|---|---|---|---|---|---|---|---|
| Hz | 286.57 | 361.85 | 401.35 | 405.89 | 441.36 | 463.00 | 527.4 |

| Mode No. | 4,2 | 5,0 | 3,3 | 0,4 | 5,1 | 1,4 | 2,4 |
|---|---|---|---|---|---|---|---|
| Hz | 645.68 | 666.56 | 691.21 | 723.41 | 736.44 | 759.65 | 874.00 |

| Mode No. | 5,2 | 4,3 | 6,0 |
|---|---|---|---|
| Hz | 917.19 | 920.66 | 1013.8 |

ACOUSTIC DEVICE

This application is a continuation-in-part of U.S. application Ser. No. 10/219,932, filed Aug. 16, 2002, now abandoned, which claims the benefit of U.S. provisional application Serial No. 60/315,702, filed Aug. 30, 2001.

TECHNICAL FIELD

The present invention relates to acoustic devices of the distributed resonant mode variety, and more particularly but not exclusively to distributed resonant mode loudspeakers (hereinafter referred to as 'DM loudspeakers').

BACKGROUND ART

Such loudspeakers comprising an acoustic radiator capable of supporting bending waves and a transducer mounted on the acoustic radiator to excite bending waves in the acoustic radiator to produce an acoustic output are described, for example, in WO97/09842 (incorporated herein by reference).

According to that document, the bulk properties of the acoustic radiator may be chosen to distribute the resonant ending wave modes substantially evenly in frequency. In other words, the bulk properties or parameters, e.g. size, thickness, shape, material etc., of the acoustic radiator may be chosen to smooth peaks in the frequency response caused by "bunching" or clustering of the modes. The resultant distribution of resonant bending wave modes may thus be such that there are substantially minimal clusterings and disparities of spacing. For panels of rectangular shape and isotropic bending stiffness, the document identifies particularly useful aspect ratios for the side dimensions, e.g. 1.134:1.

The transducer location may be chosen to couple substantially evenly to the resonant bending wave modes and, in particular, to lower frequency resonant bending wave modes. To this end, the transducer may be at a location where the number of vibrationally active resonance anti-nodes is relatively high and conversely the number of resonance nodes is relatively low. In the case of a rectangle, specific locations found suitable are at 3/7,4/9 or 5/13 of the distance along the axes.

Analysis as taught in WO97/09842 leads not only to preferred locations for transducer means but also to the capability to identify actual locations where any selective damping should be applied to deal with any particular undesired frequency or frequencies. WO99/02012 similarly discloses the use of mass loading at localised positions. Both disclosures address the problem of certain frequencies that are dominant (having greater than average amplitude ratios that 'stick out') and thus distort the overall frequency response of a corresponding loudspeaker.

WO00/22877 discloses the selective local positioning of masses, e.g. in the range from about 2 to 12 grams, bonded to a bending wave panel to optimally tune the coupled resonances such that the overall response is suitably tailored. This technique has the specific advantage of extending the low frequency range of the assembly.

U.S. Pat. No. 5,615,275 describes a loudspeaker including a planar diaphragm that mounted in a frame and that is coupled at its rear surface to a speaker voice coil such that the voice coil acts like a piston, pressing on the rear surface of the diaphragm and causing sufficient vibration of the diaphragm to efficiently produce sound. Masses are resiliently mounted on the diaphragm so as to improve its frequency response characteristic, the number, size and precise positioning of the weights for any particular diaphragm being determined empirically. The weights act to neutralize or counter uncontrolled movement of the diaphragm at certain frequencies.

The present invention is specific to distributed resonant mode devices and has as an objective an improvement in the uniformity of distribution of resonant modes of such devices. As will be appreciated from the aforementioned WO97/09842, an increase in the uniformity of distribution of the resonant modes that underpin the operation of this genre of device will result in an improvement of the frequency response of the device itself. This may be particularly appropriate when, due to styling considerations or the need to fit a panel in an existing space, the preferred panel dimensions discussed above are not possible.

DISCLOSURE OF INVENTION

Accordingly, the invention consists a method of improving the modal resonance frequency distribution of a panel for a distributed resonant mode bending wave acoustic device, the method comprising the steps of:

(a) analysing the distribution of the modal resonance frequencies of the panel;

(b) identifying a modal resonance frequency that is non-uniformly spaced relative to adjacent modal resonance frequencies;

(c) identifying a location on said panel that exhibits anti-nodal behaviour at said modal resonance frequency; and (d) changing the local impedance to bending wave vibration at said location.

Varying the local impedance at one or more locations on the panel corresponding to an anti-node at a particular modal resonance frequency results in a shift in frequency of that particular resonant mode. The present inventors have used this effect to reposition in the frequency spectrum one or more resonance frequency(s) that have been identified using analysis as being non-uniformly spaced relative to adjacent modal resonance frequencies. In this way, the uniformity of distribution of modal resonance frequencies of the device as a whole is improved.

Such variation of local impedance may also give rise to additional resonant modes which, appropriately positioned in the frequency spectrum, can also contribute to the overall uniformity of distribution of modal resonance frequencies.

The local mechanical impedance, $Z_m$ can be generally expressed in the form:

$$Z_m = j\omega.\text{mass} + \text{damping} + \text{stiffness}/j\omega$$

and be any combination, singly or together, of damping, mass or stiffness. It will be evident that such impedance to bending wave vibration acts primarily in a direction perpendicular to the plane of the panel.

Advantageously, the location is identified such that it exhibits nodal behaviour at a second resonance frequency neighbouring said modal resonance frequency in addition to exhibiting anti-nodal behaviour at said modal resonance frequency.

The method may also comprise identifying a plurality of modal resonance frequencies that are non-uniformly spaced relative to respective adjacent modal resonance frequencies, identifying a plurality of locations on said panel that exhibit anti-nodal behaviour at respective modal resonance frequencies, and changing the local impedance to bending wave vibration at one or more of said plurality of locations.

The method may further comprise the step of iteratively changing said local impedance so as to improve the modal resonance frequency distribution of said panel, alternatively it may comprise the steps of changing said local impedance by various amounts, measuring the respective uniformity of modal resonance frequency distribution and interpolating therefrom preferred values of local impedance change. The step of measuring may comprise calculating the least squares central difference of mode frequencies.

In particular, the step of interpolating may comprise identifying values of local impedance change corresponding to a modal resonance frequency distribution better than that of a corresponding rectangular panel having isotropic material properties and optimal aspect ratio. Alternatively, it may comprise the steps of changing said local impedance by various amounts, measuring the respective changes in modal resonance frequency distribution and interpolating therefrom the optimal value of local impedance change.

As regards the step of changing the local impedance, this may comprise changing the mass of the panel at said location, in particular attaching a discrete mass to the panel, advantageously by means of a member having compliance and/or by means of a member having damping. In particular, the discrete mass may be attached to the panel by means of a resilient foam member.

The step of changing the local impedance may also comprise varying the stiffness or damping of the panel at said location.

BRIEF DESCRIPTION OF DRAWINGS

The invention will now be described by way of example by reference to the attached diagrams, of which.

DETAILED DESCRIPTION OF DRAWINGS

Figure 1A:
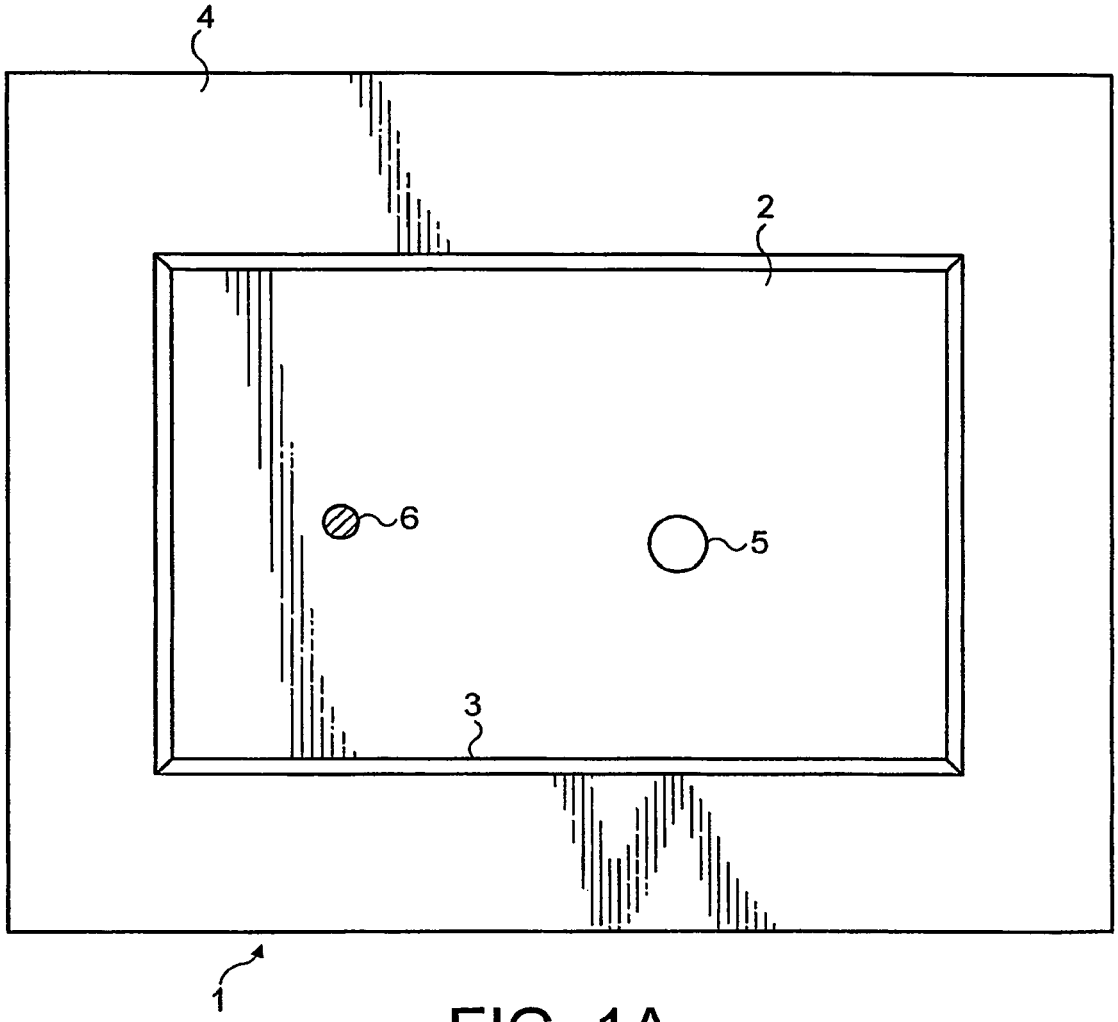
FIG. 1A is a schematic diagram of a distributed resonant mode loudspeaker.

FIG. 1A is a schematic diagram of a distributed resonant mode loudspeaker 1 of the kind known e.g. from the aforementioned WO97/09842 and comprising a panel 2 mounted in a frame 4 by means of a suspension 3, the panel carrying an exciter 5. Such an arrangement is well known in the art and consequently requires no further discussion. For the purposes of the present example, we assume generally isotropic material properties, zero stiffness suspension on all sides and dimensions of 288×216×2 mm (corresponding to a panel aspect ratio of 1.33:1). As such, the panel differs from the preferred 1.134:1 aspect ratio described in WO97/09842.

Figures 1B, 10:
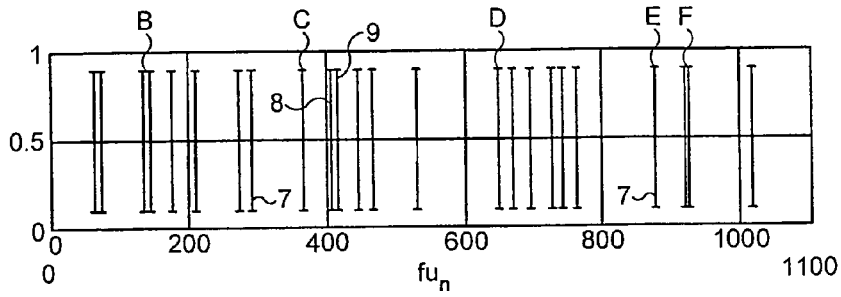
FIG. 1B illustrates the distribution of modal resonance frequencies of the panel of 1A.
FIG. 10 is a table (Table 1) of modal frequency values.

To improve the modal frequency distribution of such a loudspeaker in accordance with the method of the present invention, it is firstly necessary to analyse the distribution of the modal resonance frequencies of the panel. FIG. 1B illustrates by means of vertical lines 7 the distribution of modal resonance frequencies across the frequency spectrum for the panel of FIG. 1A as determined by the well-known analytical technique of finite element analysis (FEA). Alternatively, the distribution of modal resonance frequencies could be measured empirically, as is well known in the art. Corresponding frequency values for the first 24 modes are given in table 1 (see FIG. 10).

Thereafter, it is necessary to identify at least one modal resonance frequency that is non-uniformly spaced relative to adjacent modal frequencies. In the case of FIG. 1, it will be evident from visual inspection that there are big gaps in the distribution at 600 Hz and 800 Hz together with bunching of modes at 400 Hz and 920 Hz.

Considering the non-uniformly spaced modes at around 400 Hz, for example, the bunching of modes at this frequency can be reduced by lowering the frequency of the (4,0) mode at 401 Hz (indicated by line 8), preferably without lowering the (1,3) mode at 405 Hz indicated by line 9.

Figure 1C:
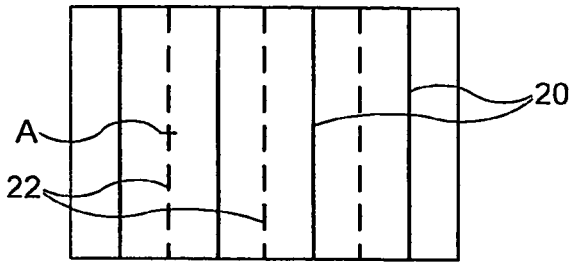
FIG. 1C is an idealised plot showing the nodal lines for the (4,0) mode.

Subsequently, a location on the panel is identified that exhibits anti-nodal behaviour at the modal resonance frequency of interest—401 Hz in the present example. FIG. 1C is an idealised plot, again obtained by Finite Element Analysis, showing the nodal lines 20 for the (4,0) mode at 401 Hz. As will be understood, regions of anti-nodal behaviour lie mid-way between the modal lines as shown by dashed lines 22 and it is at such locations that local impedance should be changed in accordance with the present invention. It will be appreciated that the above identification step could also be carried out by other means, for example by subjecting a trial panel to laser analysis as is well known, e.g. from WO99/56497.

Figure 1D:
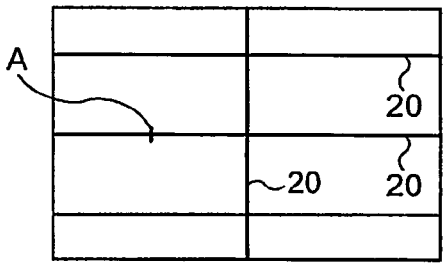
FIG. 1D is an idealised plot showing the nodal lines for the (1,3) mode.

Preferably, the effect of such impedance changes on adjacent modes in the frequency spectrum—such as the (3,1) mode at 405 Hz—is minimised by selecting the location for impedance variation such that it exhibits nodal behaviour at a second resonant frequency neighbouring the resonant modal frequency in addition to exhibiting anti-nodal behaviour at the resonant modal frequency. FIG. 1D shows nodal lines for the neighbouring (1,3) mode, and from comparison with FIG. 1C it will be evident that there is a point (indicated by cross A) located at about ¼ on X and ½ on Y (i.e. at 72×108 mm from a corner) that will couple to the (4,0) mode but not to the (1,3) mode.

According to a final step of the present invention, the local impedance to bending wave vibration in said location A is changed. To achieve a lowering of the 401 Hz modal resonance frequency of interest as mentioned above, the impedance to bending wave vibration at said location is advantageously changed by changing the mass of the panel at the location, in particular increasing the mass of the panel by the attachment of a discrete mass to the surface of the panel as indicated at 6 in FIG. 1A.

The actual amount of mass to be added can be determined by iteratively changing the local impedance so as to improve the modal resonance frequency distribution of the panel: in the present example, a mass of 4.3 g was tried, representing an arbitrary 10% of the total 43 g mass of the panel.

Figure 2:
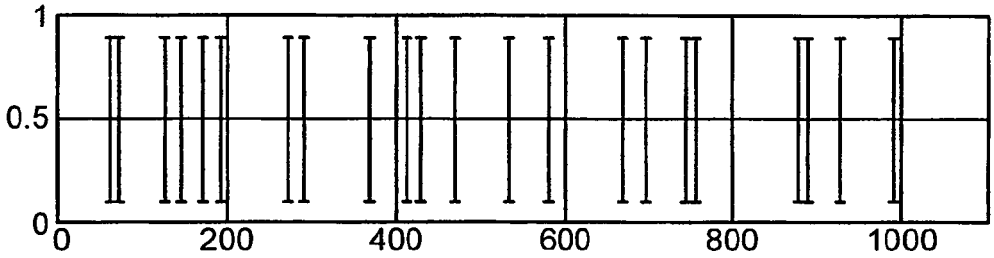
FIGS. 2 and 3 illustrate the distribution of modal resonance frequencies of the panel of 1A after successive applications of the method of the present invention.
Figure 3:
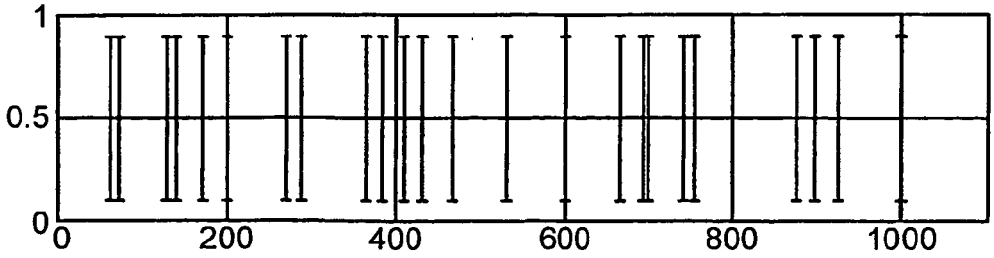

The resulting distribution of the first 24 modes are shown in the FEA simulation of FIG. 2. Examination of the results suggested that the mass was over compensating, as evidenced by the mode dropping further than necessary to even up the frequency distribution. Consequently, the analysis was repeated using half the mass (2.15 g), the first 24 modes of this new arrangement being shown in FIG. 3, from which it will be seen that this final arrangement usefully separates the (4,0) and (3,1) modes at 400 Hz and improves the overall uniformity of frequency distribution.

Uniformity of modal frequency distribution can also be expressed numerically by means of so-called 'cost functions', a variety of which are described in WO99/56497 (incorporated herein by reference). In the present example, uniformity is measured by the value, L, of the least squares central difference of modal resonance frequencies, i.e.

$$L = \sqrt{\sum_{m=1}^{M-1} \frac{(f_{m-1} + f_{m+1} - 2f_m)^2}{M-1}}$$

where $f_m$ is the frequency of the mth mode (0<=m<=M)

Figure 4:
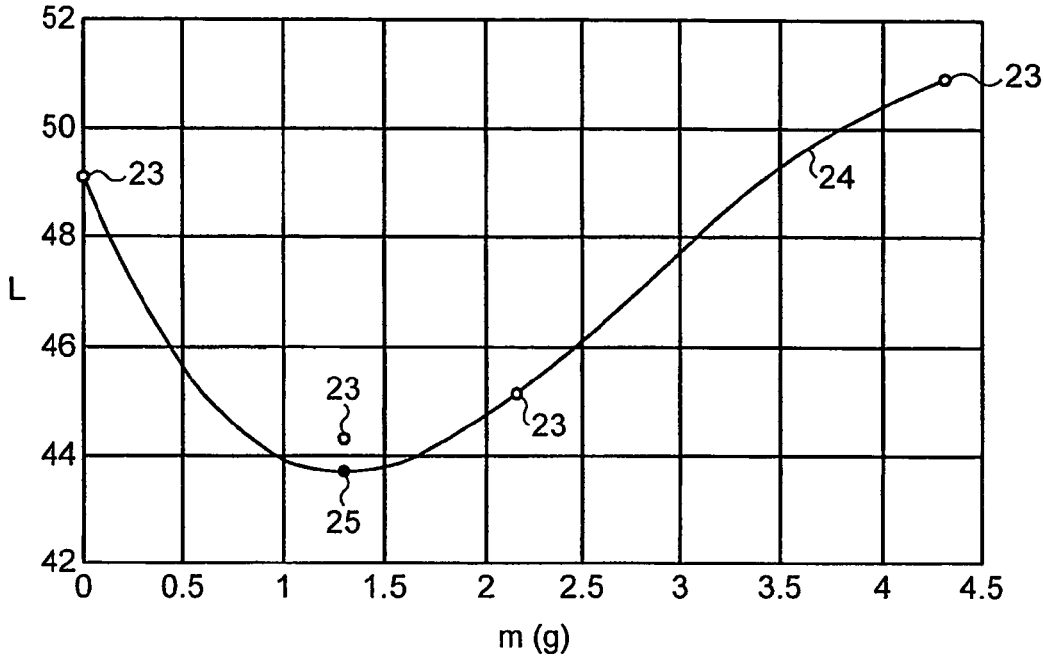
FIG. 4 shows values of cost function (L) for four discrete values of mass (m) when added to the FEA model of FIG. 1.
Figure 5:
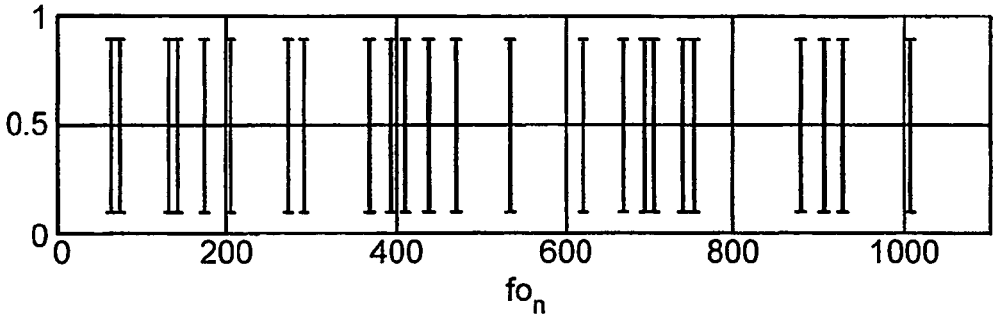
FIG. 5 illustrates the distribution of modal resonance frequencies of a panel optimised in accordance with FIG. 4.

FIG. 4 shows values 23 of cost function (L) for various discrete amounts of mass (m in grams) when added to the FEA model of FIG. 1. Interpolating from these values, e.g. by fitting a quadratic curve 24 to the modal resonance frequency values 24, suggests an optimum 25 at m=1.29 g giving a minimum cost function of approximately 44. FIG. 5 illustrates the distribution over the frequency spectrum of the first 24 modes of this optimal arrangement.

However, it will be clear from FIG. 4 that any mass greater than zero but less than 3.4 g will give better uniformity than an unmodified panel (mass=0). Furthermore, values of mass between about 0.8 g and 1.9 g will give a value of L lower than the 44.4 obtained for a corresponding unmodified rectangular panel of the kind shown in FIG. 1A, having identical area and material, isotropic material properties and the 'ideal' aspect ratio of 1.134:1 mentioned above.

The present invention is not restricted to single modes and also foresees the identification of a plurality of modal resonance frequencies that are non-uniformly spaced relative to respective adjacent modal resonance frequencies. From further consideration of FIG. 1B and the list of modes in table 1, it will be seen that non-uniform spacing of resonant modes also occurs as indicated by reference signs B–G on FIG. 1B. It will also be evident that this can be remedied by reducing the frequencies of the mode (0,2) at 131 Hz, (0,3) at 361 Hz, (4,0) at 401 Hz, (4,2) at 645 Hz, (2,4) at 874 Hz and (5,2) at 917 Hz.

Figure 6A:
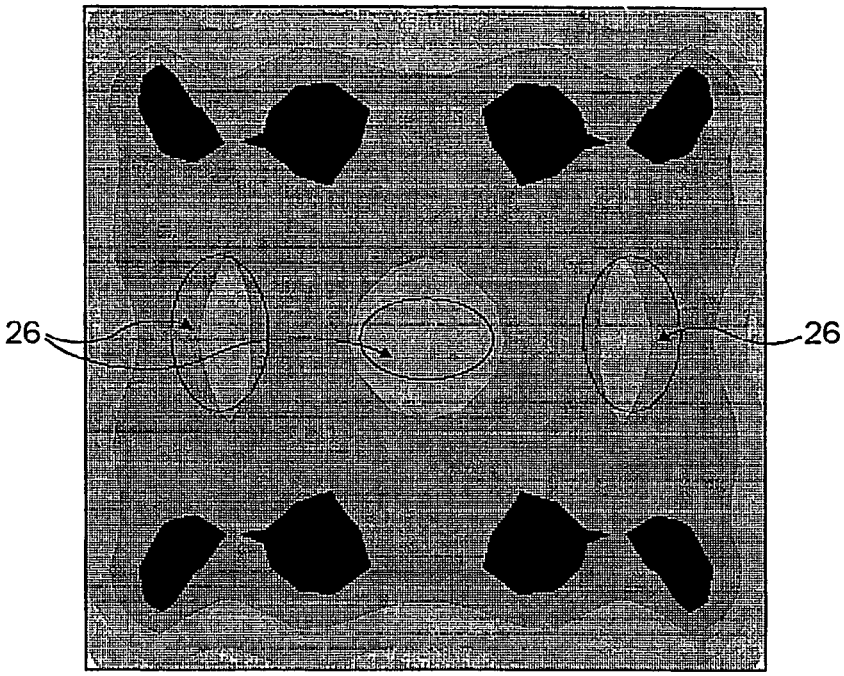
FIGS. 6A–D are 'drive maps' for the panel of FIG. 1A.

Finite element analysis to identify locations on the panel that exhibit anti-nodal behaviour at these modal resonance frequencies (in accordance with the third step of the invention) results in the 'drive map' of FIG. 6A in which successively greater values of mean vibration amplitude are indicated by successively lighter shading. Areas of the panel having the greatest vibration amplitude, i.e. anti-nodal behaviour, when simultaneously excited at the six resonance frequencies listed above are indicated at 26. It is at one or more of this plurality of locations that the local impedance to bending wave vibration needs to be changed—for example increased—in accordance with the fourth step of the present invention.

Within areas 26, it may be advantageous to choose specific locations where the response to each of the six resonant frequencies in question is 'smooth', i.e. uniform, thereby preserving/enhancing the overall smoothness of frequency response of the device. Such areas are denoted by areas 28 of zero shading in FIG. 6B.

Alternatively or in addition, local impedance variation may be restricted to those of the aforementioned regions where there is additionally substantially no anti-nodal behaviour at frequencies other than the identified frequencies. FIG. 6C is a drive map for such other frequencies in which successively lower degrees of anti-nodal behaviour are indicated by successively darker shading.

It will be evident from FIG. 6C that the majority of the area of the panel meets the criterion of no anti-nodal behaviour. However, application of a 'smoothness' criterion similar to described above highlights the areas results in the FIG. 6D, with successively lighter shading corresponding to successively greater uniformity of response across all modes other than the six of interest.

Figure 6B:
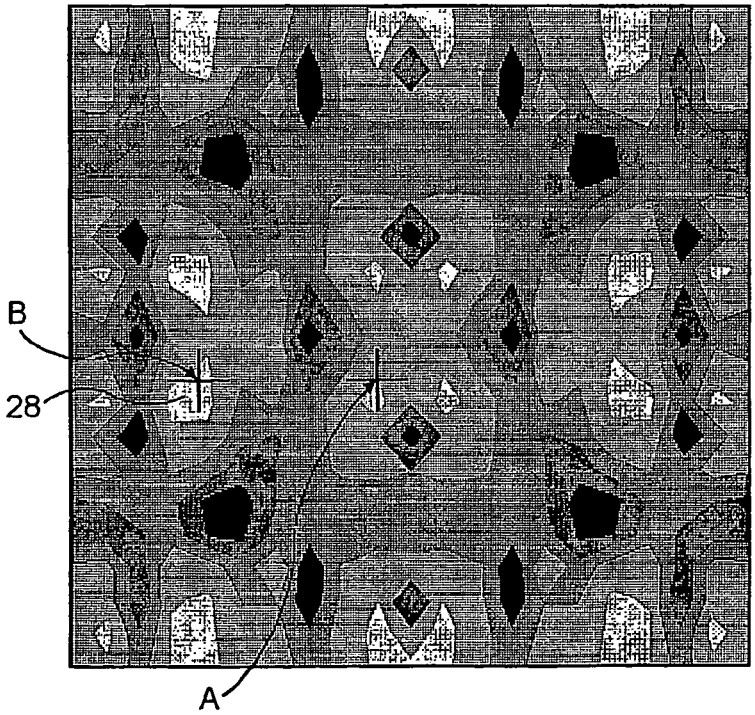
Figure 6C:
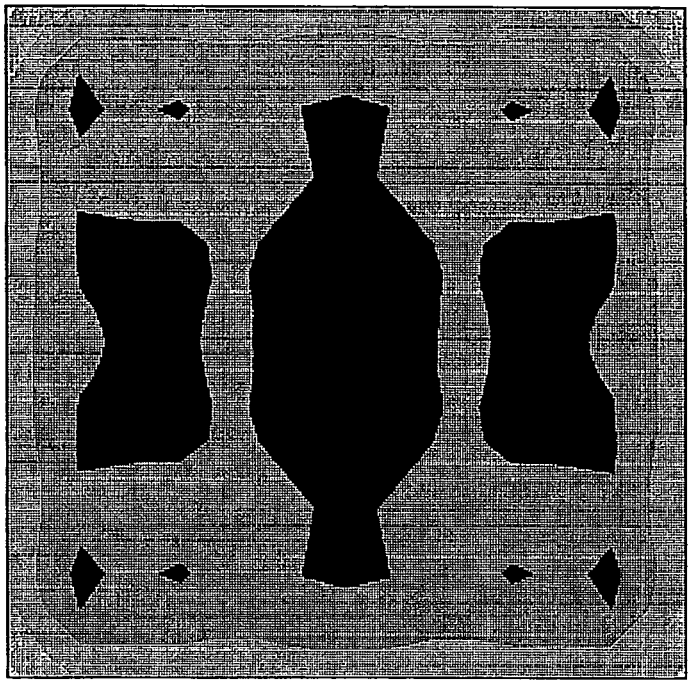
Figure 6D:
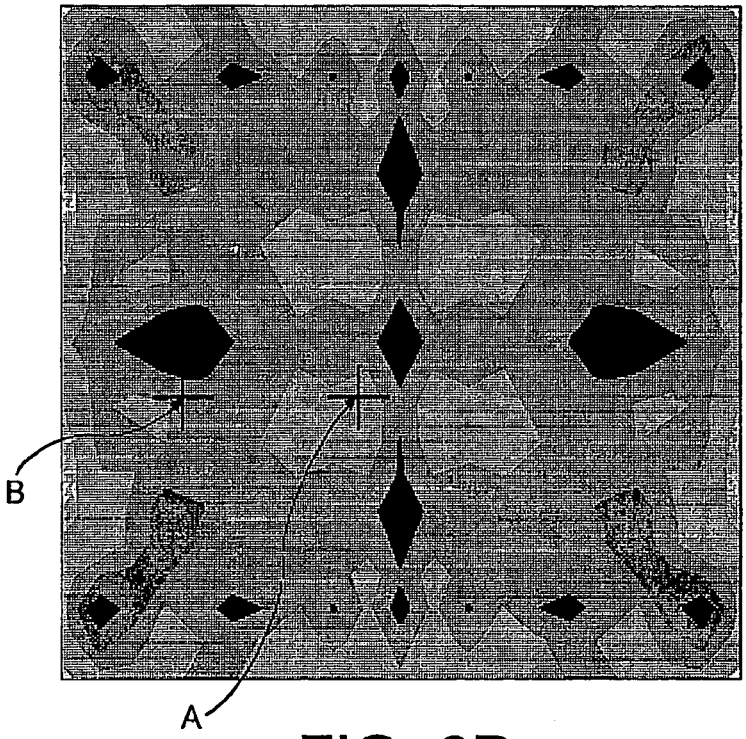

Comparison by eye of FIGS. 6B and 6D suggests that best improvement in overall uniformity of frequency distribution together with frequency level is to be had by changing the impedance at a location shown at A in FIGS. 6B and 6D (relative co-ordinates x=0.45, y=0.40), with the next best improvement being obtained at location B having relative co-ordinates x=0.18 and y=0.41. It will be noted that each of these co-ordinates may be reflected in either or both of the x and y axes.

Figure 7A:
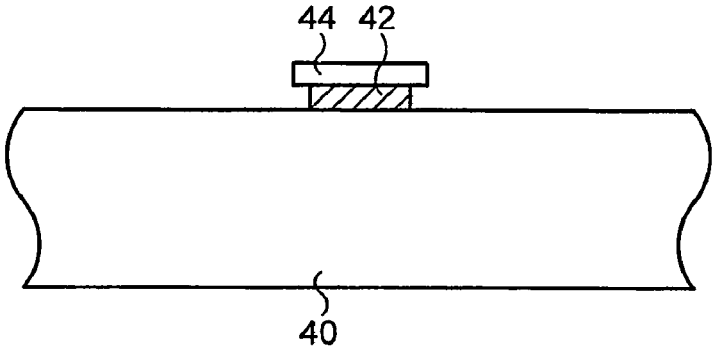
FIGS. 7A and 7B show respectively a diagrammatic sectional view through a panel improved according to another embodiment of the invention and the resulting distribution of modal resonance frequencies.
Figure 7B:
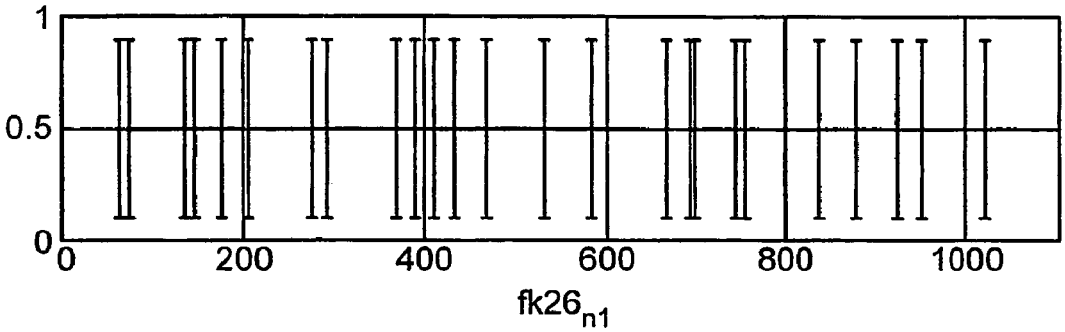

FIG. 7A is a diagrammatic sectional view through a panel according to an alternative embodiment of the invention in which local impedance is increased by application of both mass and stiffness in the form of a member having compliance (resilient foam pad, 42) which attaches the discrete 1.29 g mass 44 to the panel 40.

Since the basic panel is the same as that used in the embodiment of FIG. 1A, the non-uniformly spaced modal resonance frequency at 401 Hz and the corresponding location on the panel exhibiting anti-nodal behaviour at that modal resonance frequency also remain the same. Mass and pad are placed at that panel location in accordance with the present invention.

As regards optimisation of the local impedance represented by the mass and pad, a good first step approximation to the optimum may be achieved by using the mass value of the first embodiment and optimising the pad stiffness using the iterative or 'cost function'-based optimisation processes described above with regard to mass. In the present example, spring stiffnesses between 10 N/mm and 100 N/mm were analysed to find the optimum value, which comes out at 26.3 N/mm.

In the resulting mode distribution, shown in FIG. 9B, a slightly higher stiffness separates two modes at 700 Hz at the expense of a slightly bigger gap at 800 Hz. Further advantage is to be had from the fact that at higher frequencies where the mass could have an adverse effect on the frequency response, the stiffness serves to de-couple the mass from the panel.

Figure 8A:
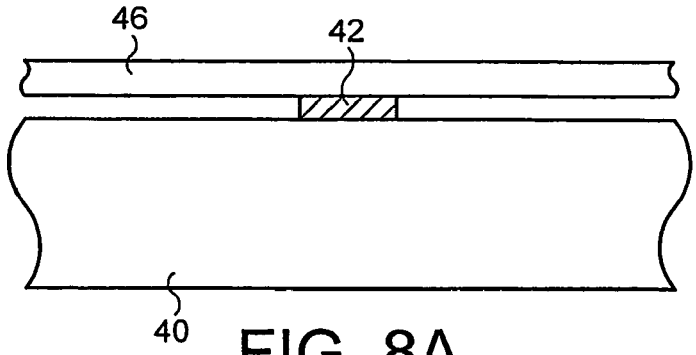
FIGS. 8A and 8B are sectional views of alternative arrangements to that of FIG. 7A.
Figure 8B:
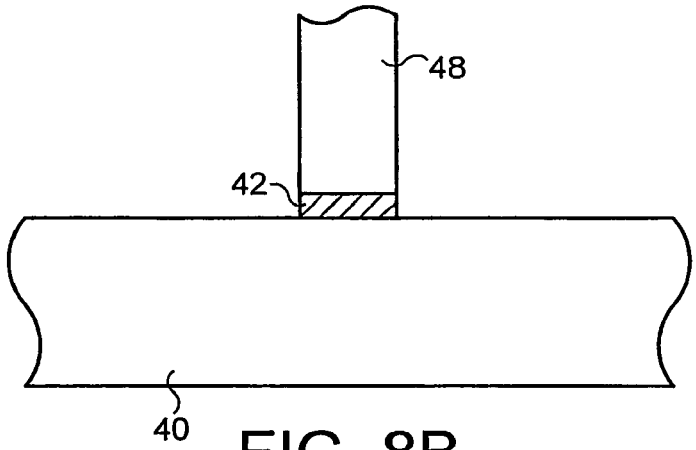

An example of how local impedance can be changed by varying the stiffness of the panel at said location is shown schematically in FIG. 8A. Instead of being attached to a mass, as in FIG. 7A, panel-mounted compliant member (foam pad 42) is grounded on the frame of the loudspeaker (as shown at 4 in FIG. 1), for example by means of a strut 46 spanning the rear of the frame. Alternatively, as shown in FIG. 8B, grounding may be by way of an extension 48 mounted on a baffle box (not shown) again extending behind the rear of a frame.

Figure 9:
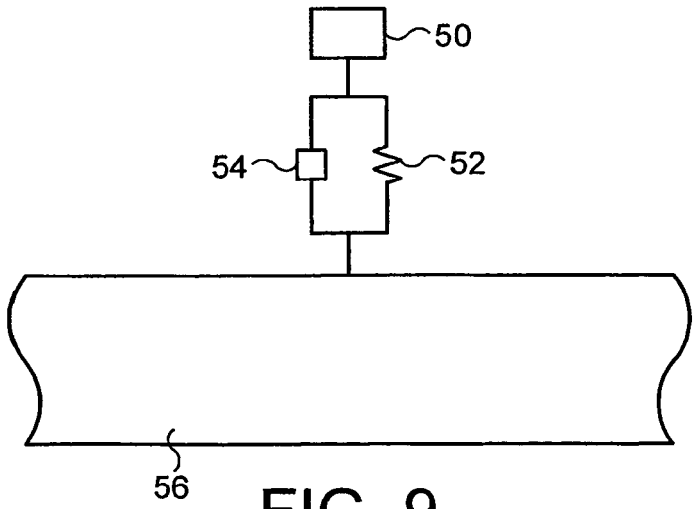
FIG. 9 is a diagrammatic representation of a further mode of implementation of the present invention.

A diagrammatic representation of yet another embodiment is given in FIG. 9, which shows a panel 56 having a damper 54 in addition to mass 50 and spring 52. Such damping will, in practice, be inherent in any resilient foam pad per the previous embodiment and can be varied by the choice of foam used. Optimisation of the damping value is advantageously achieved using the methods outlined above and on the basis of the mass and stiffness values determined for previous embodiments. In particular, damping can be used to balance the energy distribution of the redistributed modes obtained by the methods of the previous embodiments.

It will be appreciated that the invention has been described by way of examples only and that a wide variety of modifications can be made without departing from the scope of the invention.

For example, the previous embodiments all specify the step of increasing local impedance at chosen location(s). Certainly, this is the easiest to implement (by simple attachment of mass etc.) given the starting point of a simple panel. However, situations may arise where an improvement in uniformity of frequency distribution is best achieved by a reduction in local impedance, e.g. by locally removing and/or replacing the material of the panel.

Furthermore, the invention is not restricted to vibrational movement perpendicular to the plane of the member: attachments which couple into rotational degrees of freedom of the member may be used as an alternative or in addition. Examples of such attachments include torsional springs and attachments with a large moment of inertia.

It will also be appreciated that acoustic devices other than loudspeakers, e.g. microphones, fall within the scope of the present invention. However, apart from the replacement of any exciter by a pick-up, the differences from the loudspeaker embodiments outlined above will generally be minimal.

The invention claimed is:

1. Method of improving the modal resonance frequency distribution of a panel for a panel-form distributed resonant mode bending wave acoustic device, the method comprising the steps of:

(a) analysing the distribution of the modal resonance frequencies of the panel;

(b) identifying a modal resonance frequency that is non-uniformly spaced relative to adjacent modal resonance frequencies;

(c) identifying a location on said panel that exhibits anti-nodal behaviour at said modal resonance frequency; and (d) changing the local impedance of the panel to bending wave vibration at said location.

2. Method according to claim 1, wherein the location identified in step (c) exhibits nodal behaviour at a second resonance frequency neighbouring said modal resonance frequency in addition to exhibiting anti-nodal behaviour at said modal resonance frequency.

3. Method according to claim 1, wherein step (b) comprises identifying a plurality of modal resonance frequencies that are non-uniformly spaced relative to respective adjacent modal resonance frequencies; step (c) comprises identifying a plurality of locations on said panel that exhibit anti-nodal behaviour at respective modal resonance frequencies; and step (d) comprises changing the local impedance to bending wave vibration at one or more of said plurality of locations.

4. Method according to claim 1, further comprising the step of iteratively changing said local impedance so as to improve the modal resonance frequency distribution of said panel.

5. Method according to claim 1, further comprising the steps of changing said local impedance by various amounts; measuring the respective uniformity of modal resonance frequency distribution; and interpolating from the measured uniformity of modal resonance frequency distribution preferred values of local impedance change.

6. Method according to claim 5, wherein the step of measuring comprises calculating the least squares central difference of mode frequencies.

7. Method according to claim 5, wherein the step of interpolating comprises identifying values of local impedance change corresponding to a modal resonance frequency distribution that is better than that of a corresponding rectangular panel having isotropic material properties and an optimal aspect ratio.

8. Method according to claim 5, further comprising the steps of changing said local impedance by various amounts; measuring the respective changes in modal resonance frequency distribution; and interpolating from the measured changes in modal resonance frequency distribution the optimal value of local impedance change.

9. Method according to claim 5, wherein the step of changing the local impedance comprises changing the mass of the panel at said location.

10. Method according to claim 9, wherein the step of changing the local impedance comprises attaching a discrete mass to the panel.

11. Method according to claim 10, wherein the step of changing the local impedance comprises attaching the discrete mass to the panel by means of a member having compliance.

12. Method according to claim 11, wherein the step of changing the local impedance comprises attaching the discrete mass to the panel by means of a member having damping.

13. Method according to claim 12, wherein the step of changing the local impedance comprises attaching said discrete mass to the panel by means of a resilient foam member.

14. Method according to claim 5, wherein the step of changing the local impedance comprises varying the stiffness of the panel at said location.

15. Method according to claim 5, wherein the step of changing the local impedance comprises varying the damping of the panel at said location.

16. Method according to claim 5, wherein step (b) comprises identifying a plurality of modal resonance frequencies that are non-uniformly spaced relative to respective adjacent modal resonance frequencies; step (c) comprises identifying a plurality of locations on said panel that exhibit anti-nodal behaviour at respective modal resonance frequencies; and step (d) comprises changing the local impedance to bending wave vibration at one or more of said plurality of locations.

17. Method according to claim 9, wherein step (b) comprises identifying a plurality of modal resonance frequencies that are non-uniformly spaced relative to respective adjacent modal resonance frequencies; step (c) comprises identifying a plurality of locations on said panel that exhibit anti-nodal behaviour at respective modal resonance frequencies; and step (d) comprises changing the local impedance to bending wave vibration at one or more of said plurality of locations.

18. Method according to claim 9, further comprising the step of iteratively changing said local impedance so as to improve the modal resonance frequency distribution of said panel.

19. Method according to claim 1, wherein the step of changing the local impedance comprises varying the damping of the panel at said location.

20. Method according to claim 1, wherein the step of changing the local impedance comprises varying, the stiffness of the panel at said location.

21. Method according to claim 1, wherein the step of changing the local impedance comprises varying the damping of the panel at said location.

* * * * *